US011879479B2

(12) United States Patent
Wu et al.

(10) Patent No.: US 11,879,479 B2
(45) Date of Patent: Jan. 23, 2024

(54) FLOW GUIDING ELEMENT, HEAT COLLECTING PUMP AND DISHWASHER

(71) Applicant: FOSHAN SHUNDE MIDEA WASHING APPLIANCES MANUFACTURING CO., LTD., Foshan (CN)

(72) Inventors: Jianqing Wu, Foshan (CN); Richao Liu, Foshan (CN); Xiang Li, Foshan (CN); Canhua Qiu, Foshan (CN); Pingping Xu, Foshan (CN)

(73) Assignee: FOSHAN SHUNDE MIDEA WASHING APPLIANCES MANUFACTURING CO., LTD., Foshan (CN)

( * ) Notice: Subject to any disclaimer, the term of this patent is extended or adjusted under 35 U.S.C. 154(b) by 0 days.

(21) Appl. No.: 17/921,345

(22) PCT Filed: Apr. 26, 2021

(86) PCT No.: PCT/CN2021/089998
§ 371 (c)(1),
(2) Date: Oct. 25, 2022

(87) PCT Pub. No.: WO2021/218927
PCT Pub. Date: Nov. 4, 2021

(65) Prior Publication Data

US 2023/0258201 A1 Aug. 17, 2023

(30) Foreign Application Priority Data

Apr. 30, 2020 (CN) ..... 202010365913.9
Apr. 30, 2020 (CN) ..... 202020714834.X
Nov. 9, 2020 (CN) ..... 202011241371.0
Nov. 9, 2020 (CN) ..... 202022578284.6

(51) Int. Cl.
*F04D 29/44* (2006.01)
*F04D 29/58* (2006.01)
*A47L 15/42* (2006.01)

(52) U.S. Cl.
CPC ..... *F04D 29/447* (2013.01); *F04D 29/586* (2013.01); *A47L 15/4225* (2013.01); *A47L 15/4285* (2013.01)

(58) Field of Classification Search
CPC ..... F04D 29/447; F04D 29/448
See application file for complete search history.

(56) References Cited

FOREIGN PATENT DOCUMENTS

| | | | |
|---|---|---|---|
| CN | 107503980 | A | 12/2017 |
| CN | 108194423 | A | 6/2018 |
| CN | 108331785 | A | 7/2018 |
| CN | 109154308 | A | 1/2019 |

(Continued)

OTHER PUBLICATIONS

International Search Report dated Jul. 14, 2021 for PCT No. PCT/CN2021/089998.

(Continued)

*Primary Examiner* — Brian O Peters

(57) ABSTRACT

Provided are a flow guiding element, a heat collecting pump, and a dishwasher. The flow guiding element includes an annular portion and flow guiding pieces. The flow guiding pieces is connected to a periphery of the annular portion, and arranged in a circumferential direction of the annular portion. Each of the flow guiding pieces spirals upwards in the circumferential direction of the annular portion.

14 Claims, 6 Drawing Sheets

(56) References Cited

FOREIGN PATENT DOCUMENTS

| | | | |
|---|---|---|---|
| CN | 110080988 | A | 8/2019 |
| CN | 110631268 | A | 12/2019 |
| CN | 110822718 | A | 2/2020 |
| CN | 111481146 | A | 8/2020 |
| CN | 111481147 | A | 8/2020 |
| CN | 112244729 | A | 1/2021 |
| CN | 212394857 | U | 1/2021 |
| DE | 102011003464 | A1 | 4/2012 |
| EP | 2495444 | A2 | 9/2012 |
| EP | 2628958 | A2 | 8/2013 |
| JP | S5412103 | U | 1/1979 |
| JP | 2012518262 | A | 8/2012 |
| WO | 2006136819 | A2 | 12/2006 |

OTHER PUBLICATIONS

First OA with search report dated Jan. 12, 2021 for CN Application No. 202010365913.9.

Second OA with search report dated Jul. 21, 2021 for CN Application No. 202010365913.9.

Grant Notice dated Jan. 18, 2022 for CN Application No. 202010365913.9.

Supplementary European Search Report received in EP Application No. 21797046.6; dated Sep. 29, 2023.

FLOW GUIDING ELEMENT, HEAT COLLECTING PUMP AND DISHWASHER

CROSS-REFERENCES TO RELATED APPLICATIONS

The present disclosure is a national phase application of International Application No. PCT/CN2021/089998, filed on Apr. 26, 2021, which claims priorities to and benefits to Chinese Patent Applications No. 202010365913.9 and No. 202020714834.X, both filed on Apr. 30, 2020, and to Chinese Patent Applications No. 202022578284.6 and No. 202011241371.0, both filed on Nov. 9, 2020, the entire disclosures of which are incorporated herein by reference.

FIELD

The present disclosure relates to the field of electric appliance technologies, and more particularly, to a flow guiding element, a heat collecting pump, and a dishwasher.

BACKGROUND

A heat collecting pump is a device that can increase a fluid pressure of a fluid heat collecting pump. The heat collecting pump may be applied in a dishwasher to improve a cleaning rate of the dishwasher. In the related art, the heat collecting pump is provided with a heating element. The heating element can heat a liquid in the heat collecting pump. However, the heating element may increase resistance of the fluid, which results in lower fluid delivering efficiency of the heat collecting pump.

SUMMARY

The present disclosure provides a flow guiding element, a heat collecting pump, and a dishwasher.

A flow guiding element according to embodiments of the present disclosure includes an annular portion, and flow guiding pieces connected to a periphery of the annular portion and arranged in a circumferential direction of the annular portion. Each of the flow guiding pieces spirals upwards in the circumferential direction of the annular portion.

In the flow guiding element according to the embodiments, each of the flow guiding pieces spirals in the circumferential direction of the annular portion, and the flow guiding pieces can guide the fluid to flow spirally. Thus, it is possible to increase a flow rate of the fluid, which can in turn improve fluid delivering efficiency of the heat collecting pump.

In some embodiments, in the circumferential direction of the annular portion, each of the flow guiding pieces has a first end and a second end opposite to the first end. In a radial direction of the annular portion, a gap is defined between the first end and the annular portion and/or between the second end and the annular portion.

In some embodiments, in the circumferential direction of the annular portion, each of the flow guiding pieces has a first end and a second end opposite to the first end, the first end being located at a lower level than the second end. For two adjacent flow guiding pieces of the flow guiding pieces arranged in the circumferential direction of the annular portion, the second end of one of the two adjacent flow guiding pieces is located at a higher level than the first end of the other one of the two adjacent flow guiding pieces.

In some embodiments, each of the flow guiding pieces has a flow guiding surface facing upwards and a side surface connected to the flow guiding surface. The flow guiding surface has a width gradually decreasing in a spiral direction of the flow guiding piece.

In some embodiments, the side surface has a constant width in the spiral direction of the flow guiding piece.

In some embodiments, the flow guiding element further includes a support post extending downwards from each of the flow guiding pieces in an axial direction of the annular portion.

In some embodiments, the flow guiding element further includes a fluid inlet portion extending from the annular portion in an axial direction of the annular portion. The fluid inlet portion has a fluid inlet channel.

A heat collecting pump according to embodiments of the present disclosure includes a casing, and the flow guiding element according to any one of the above embodiments. The flow guiding element is disposed in the casing.

In the heat collecting pump according to the embodiments, each of the flow guiding pieces spirals in the circumferential direction of the annular portion, and the flow guiding pieces can guide the fluid to flow spirally. Thus, it is possible to increase a flow rate of the fluid, which can in turn improve fluid delivering efficiency of the heat collecting pump.

In some embodiments, the heat collecting pump further includes an impeller disposed in the casing and located below the flow guiding element. A distance between an end, close to the impeller, of each of the flow guiding pieces and a bottom of the impeller is greater than or equal to half of a thickness of the impeller.

A dishwasher according to embodiments includes the heat collecting pump according to any one of the above embodiments.

In the dishwasher according to the embodiments, each of the flow guiding pieces spirals in the circumferential direction of the annular portion, and the flow guiding pieces can guide the fluid to flow spirally. Thus, it is possible to increase a flow rate of the fluid, which can in turn improve fluid delivering efficiency of the heat collecting pump.

Additional embodiments of the present disclosure will be provided at least in part in the following description, or will become apparent at least in part from the following description, or can be learned from practicing of the present disclosure.

BRIEF DESCRIPTION OF THE DRAWINGS

The embodiments of the present disclosure will become more apparent and more understandable from the following description of implementations taken in conjunction with the accompanying drawings, in which.

Figure 1:
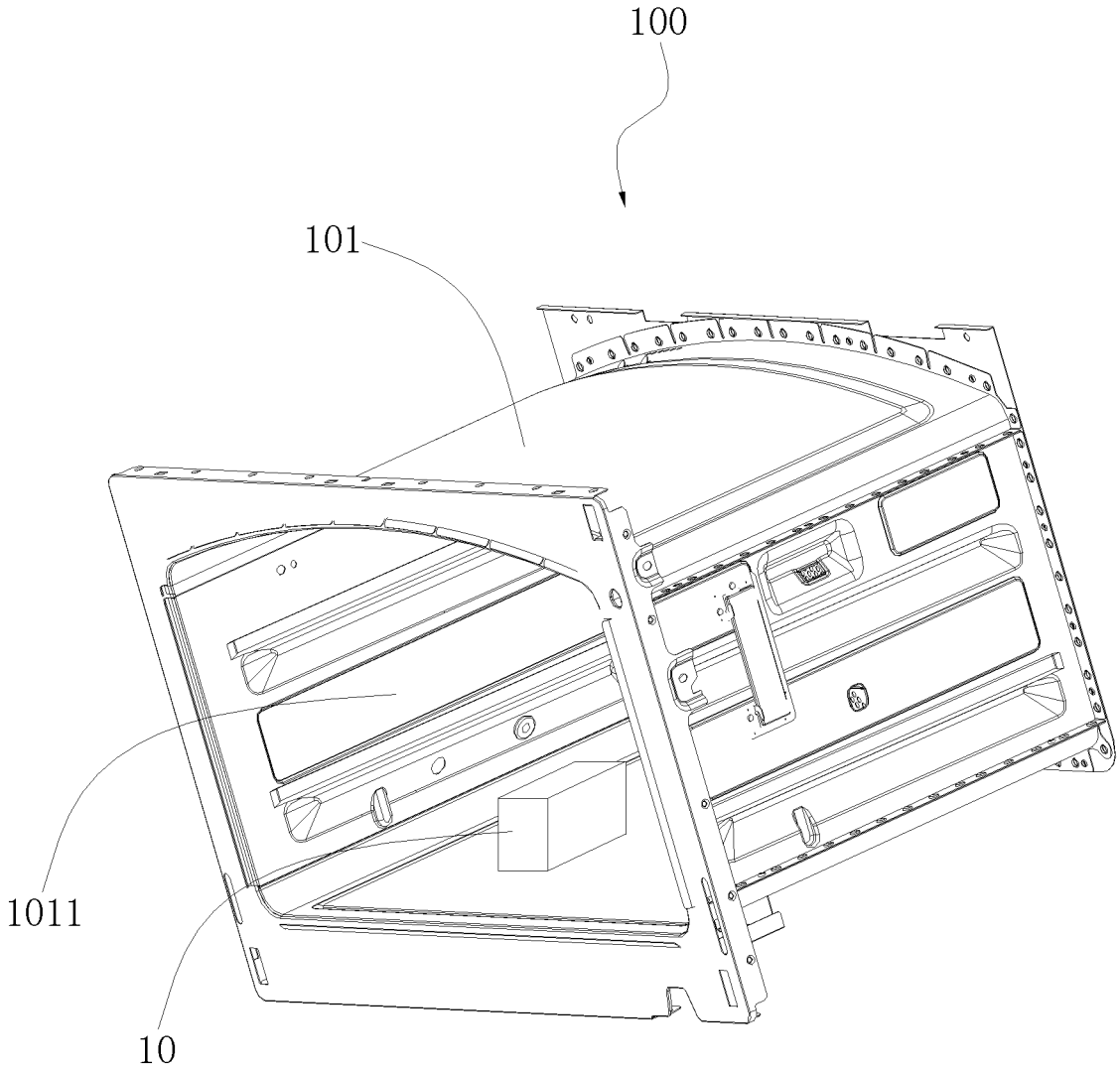
FIG. 1 is a schematic structural view of a household appliance according to an embodiment of the present disclosure.

REFERENCE NUMERALS OF MAIN COMPONENTS household appliance 100; housing 101; accommodation space 1011;

heat collecting pump 10; casing 11; upper casing 111; fluid inlet 1112; fluid outlet 1113; fluid channel 1114; heating element 1115; lower casing 112; impeller 12; motor 13;

flow guiding element 20; annular portion 21; flow guiding piece 22; first end 221; second end 222; gap 223; flow guiding surface 224; side surface 225; support post 23; fluid inlet portion 24; fluid inlet channel 241 flow guiding cover 30; spiral surface 31.

DETAILED DESCRIPTION OF THE DISCLOSURE

Embodiments of the present disclosure are described below in detail, examples of the embodiments are shown in accompanying drawings, and throughout the description, the same or similar reference numerals represent the same or similar components or the components having the same or similar functions. The embodiments described below with reference to the accompanying drawings are exemplary and merely intended to explain the present disclosure, rather than being construed as limitation on the present disclosure.

In the description of the present disclosure, it should be understood that the orientation or position relationship indicated by the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", etc., is based on the orientation or position relationship shown in the accompanying drawings, and is only for the convenience of describing the present disclosure and simplifying the description, rather than indicating or implying that the associated device or element must have a specific orientation or must be constructed and operated in a specific orientation. Thus, the orientation or position relationship indicated by these terms cannot be understood as limitations on the present disclosure. In addition, the terms "first" and "second" are only used for purpose of description, and cannot be understood as indicating or implying relative importance or implicitly indicating the number of indicated features. Therefore, the features associated with "first" and "second" may explicitly or implicitly include at least one of the features. In the description of the present disclosure, "plurality" means at least two, unless otherwise specifically defined.

In the description of the present disclosure, it should be noted that, unless otherwise clearly specified and limited, terms such as "install", "mount", "connect", "couple", and the like should be understood in a broad sense. For example, it may be a fixed connection or a detachable connection or connection as one piece; mechanical connection or electrical connection or may also communicate with each other; direct connection or indirect connection through an intermediate; internal communication of two components or the interaction relationship between two components, unless otherwise clearly limited. The specific meaning of the above-mentioned terms in the present disclosure can be understood according to specific circumstances.

In the present disclosure, unless expressly stipulated and defined otherwise, the first feature being "on" or "under" the second feature may include the scenarios that the first feature is in direct contact with the second feature, or the first and second features, instead of being in direct contact with each other, are in contact with each other by another feature therebetween. In one embodiment, the first feature being "above" the second feature may indicate that the first feature is directly above or obliquely above the second feature, or simply indicate that the level of the first feature is higher than that of the second feature. The first feature being "below" the second feature may indicate that the first feature is directly below or obliquely below the second feature, or simply mean that the level of the first feature is smaller than that of the second feature.

Various embodiments or examples for implementing different structures of the present disclosure are provided below. In order to simplify the description of the present disclosure, components and arrangements of specific examples are described herein. These specific examples are merely for the purpose of illustration, rather than limiting the present disclosure. Further, the same reference numerals and/or reference letters may appear in different examples of the present disclosure for the purpose of simplicity and clarity, instead of indicating a relationship between different embodiments and/or the discussed arrangements. In addition, the present disclosure provides examples of various specific processes and materials. However, applications of other processes and/or the use of other materials.

Referring to FIG. 1, embodiments of the present disclosure provide a household appliance 100. The household appliance 100 includes a housing 101 and a heat collecting pump 10. The housing 101 has an accommodation space 1011. The heat collecting pump 10 is mounted in the accommodation space 1011. The heat collecting pump 10 is configured to receive a fluid and heat the fluid, and then spray the heated fluid to the accommodation space 1011 to clean an object in the accommodation space 1011.

Further, the household appliance 100 may include a spray arm (not shown). The spray arm is configured to spray the heated fluid to the accommodation space 1011. The heat collecting pump 10 is in communication with the spray arm. The heat collecting pump 10 can heat the received fluid, and deliver the heated fluid to the spray arm. Then, the spray arm can spray the received heated fluid to the accommodation space 1011. The heated fluid can be sprayed in a predetermined direction through the spray arm. Thus, it is beneficial to clean the object in the accommodation space 1011. It should be understood that, in other embodiments, no spray arm is provided, and the heated fluid may be directly sprayed to the accommodation space 1011 by the heat collecting pump 10. Determining whether the spray arm is provided or not may be dependent on the actual situation, which is not limited herein.

Further, the household appliance 100 may be a dishwasher such as a drawer-type dishwasher and a sink-type dishwasher, a washing machine, a cleaning machine such as a drawer-type cleaning machine and a sink-type cleaning machine, for example. The housing 101 may be made of a metal material. For example, the housing 101 may be made of a lightweight aluminum material. In this case, the housing 101 has lighter weight, which can reduce a weight of the household appliance 100 and facilitate use of the household appliance 100 by a user. In other embodiments, the housing 101 may also be made of other materials, and the specific material of the housing 101 may be selected as desired, which is not limited herein.

Figure 2:
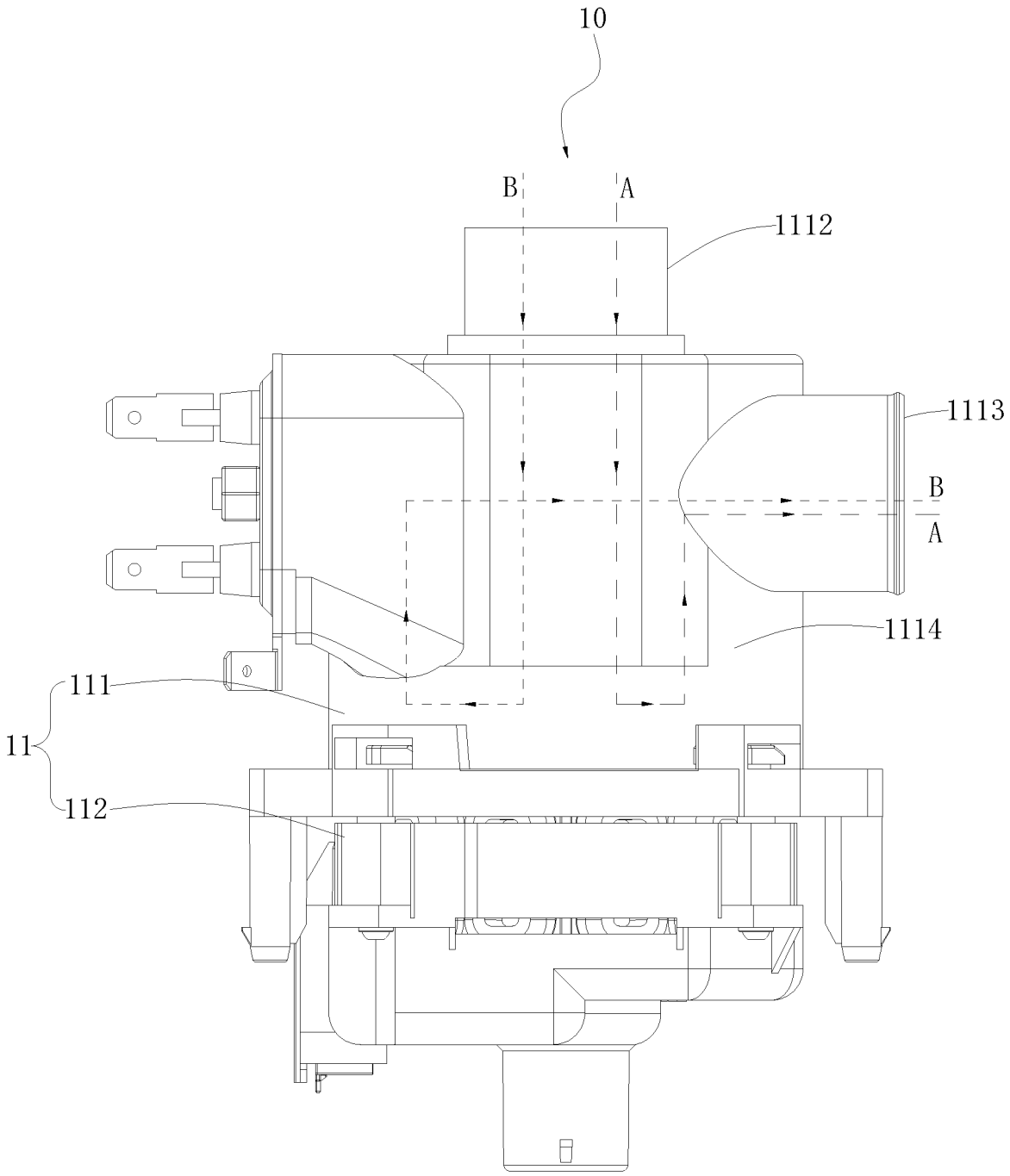
FIG. 2 is a schematic plan view of a heat collecting pump according to an embodiment of the present disclosure.
Figure 3:
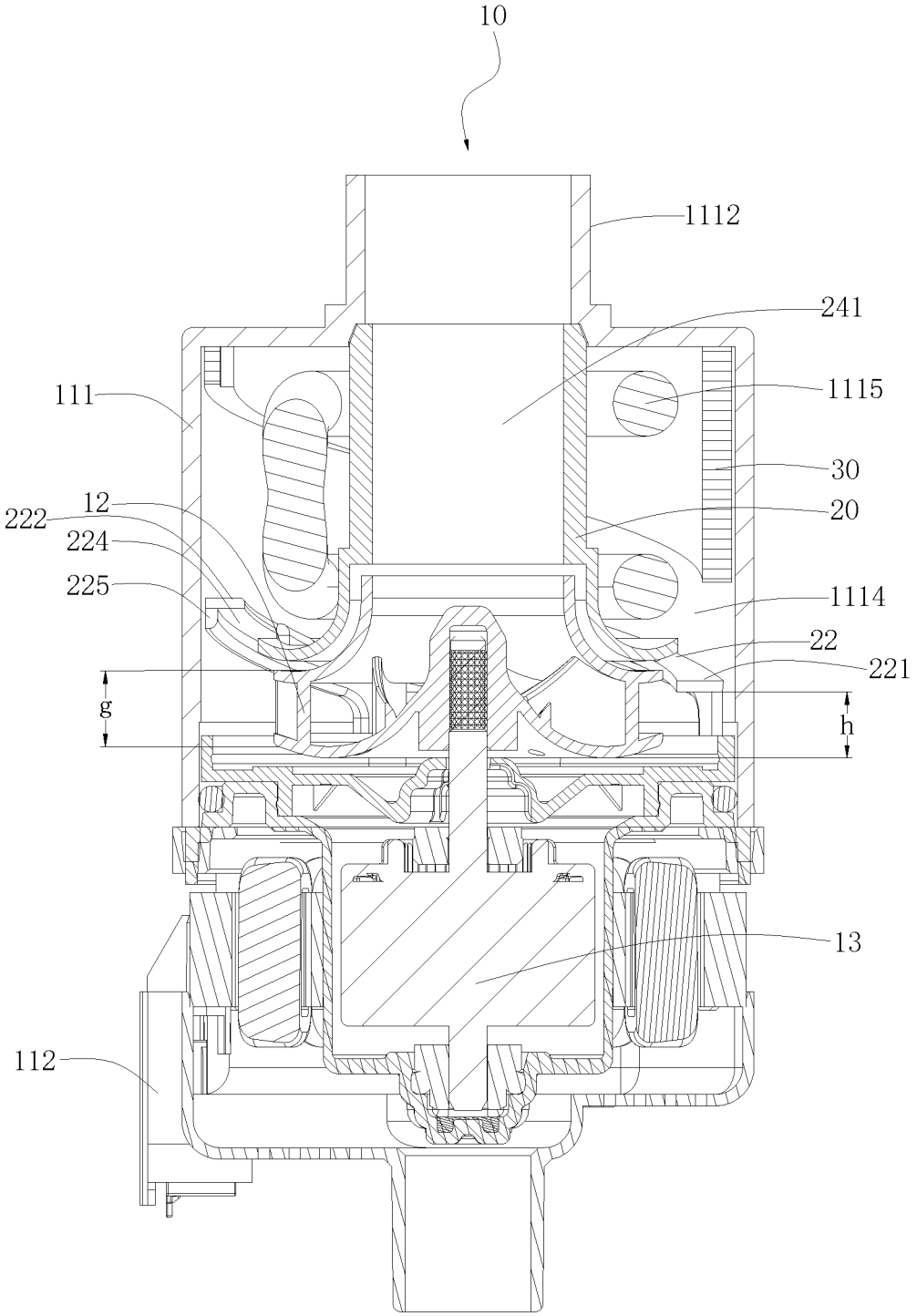
FIG. 3 is a schematic cross-sectional view of a heat collecting pump according to an embodiment of the present disclosure.
Figure 4:
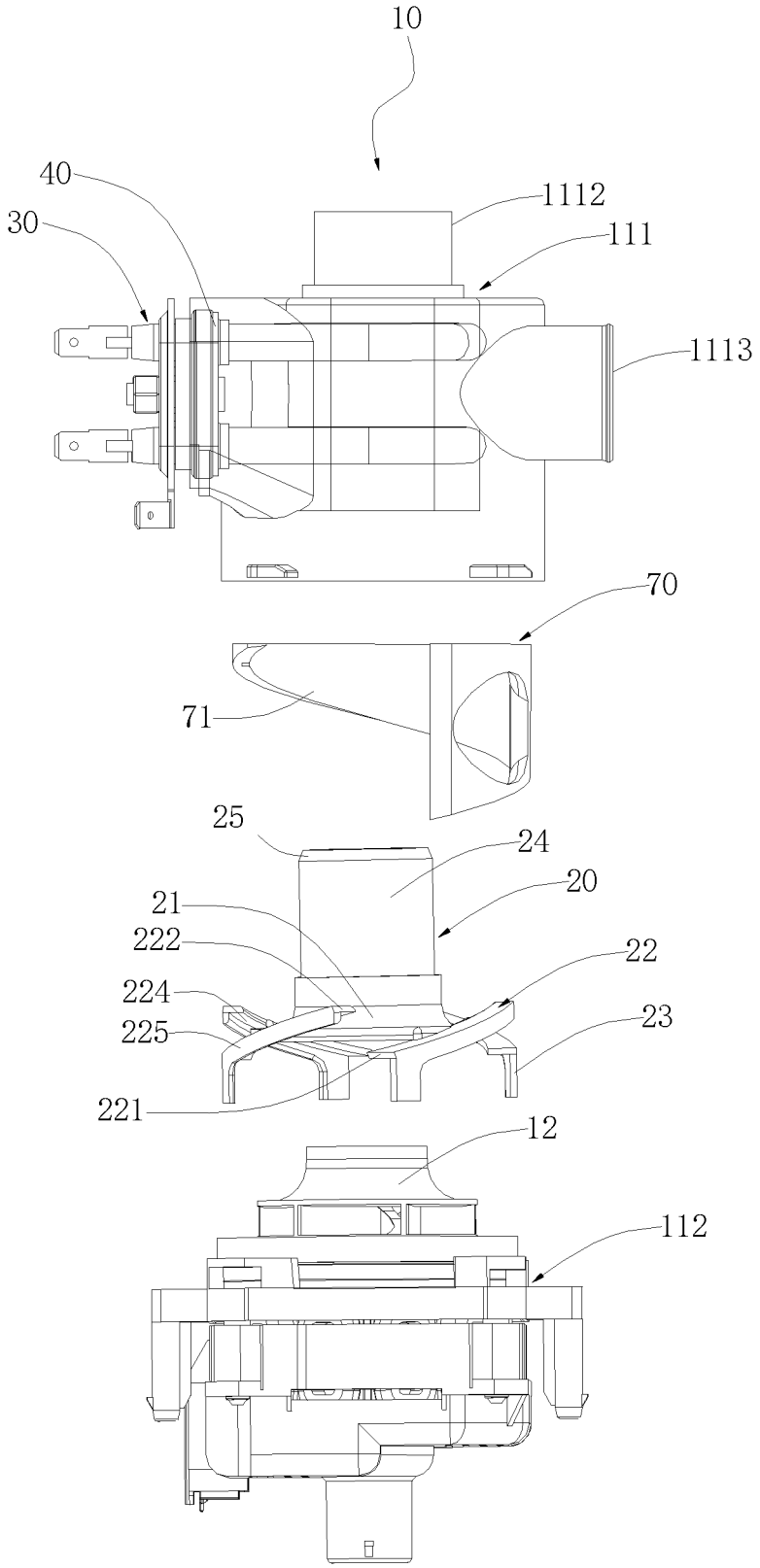
FIG. 4 is a schematic exploded view of a heat collecting pump according to an embodiment of the present disclosure.

Referring to FIG. 2 to FIG. 4, in the embodiment, the heat collecting pump 10 includes a casing 11, an impeller 12, and a flow guiding element 20. Both the flow guiding element 20 and the impeller 12 are disposed in the casing 11. In some embodiments, the impeller 12 is located below the flow guiding element 20. The arrangement of the casing 11 can protect the flow guiding element 20 from being damaged due to collision with an external structure.

In addition, the arrangement of the casing 11 facilitates an installation of the impeller 12. The casing 11 may be made of a lightweight material. For example, the casing 11 may be made of aluminum and a high-temperature-resistant plastic material. In this way, an overall weight of the heat collecting pump 10 can be reduced, which can in turn reduce an overall weight of the household appliance 100. It should be understood that, in other embodiments, the casing 11 may also be made of other materials, and the specific material of the casing 11 is not limited herein, as long as the material has advantages such as high hardness, strong corrosion resistance, high temperature resistance, and light weight.

Referring to FIG. 2 to FIG. 4, in some embodiments, the casing 11 includes an upper casing 111 and a lower casing 112 that are detachably connected to each other. In this way, when an element such as the flow guiding element 20 in the casing 11 is damaged, the casing 11 can be easily detached by the user to maintain or replace the damaged element in the casing 11, which is convenient and quick and can improve user experience. In addition, a detachable connection between the upper casing 111 and the lower casing 112 may be a rotationally assembled connection, a snapping connection, a screw fastening connection, or the like. In other embodiments, other connection may also be employed, which is not limited herein, as long as the upper casing 111 and the lower casing 112 are detachably connected to each other.

It should be understood that, in one example, the upper casing 111 and the lower casing 112 may also be integrally formed. In a further embodiment, the upper casing 111 and the lower casing 112 may be integrally formed by injection molding or by welding, which may be selected as desired and is not limited herein.

Referring to FIG. 2 to FIG. 4, in the embodiment, the upper casing 111 has a fluid inlet 1112, a fluid outlet 1113, and a fluid channel 1114 in communication with the fluid outlet 1113. The fluid channel 1114 is in communication with the fluid outlet 1113, and is provided with a heating element 1115. The flow guiding element 20 is disposed in the fluid channel 1114. The fluid guided by the flow guiding element 20 can flow in the fluid channel 1114 in a vortex form. On one hand, it is possible to facilitate a contact of the fluid with the heating element 1115 to improve heating efficiency of the fluid, and on the other hand, it is possible to increase a flow rate of the fluid to allow the fluid to fully flow through the fluid outlet 1113. Thus, fluid delivering efficiency and hydraulic performance of the heat collecting pump 10 can be improved.

In some embodiments, the heating element 1115 includes, but is not limited to, a tubular heater, a coated resistive heater, or the like, and the specific type of the heating element 1115 may be selected as desired, which is not limited herein.

Referring to FIG. 3, in some embodiments, a motor 13 is disposed in the heat collecting pump 10. In some embodiments, the impeller 12 is located in the lower casing 112. The motor 13 is disposed in the lower casing 112, and is connected to the impeller 12. The motor 13 is configured to drive the impeller 12 to rotate. The motor 13 may be a synchronous motor, an asynchronous alternating current motor, a direct current brushless motor, or the like.

In the embodiment, the impeller 12 is located within the fluid channel 1114. When the impeller 12 is driven by the motor 13 to rotate, the impeller 12 causes the fluid in the fluid channel 1114 to be formed into the vortex form. Thus, it is possible to increase the flow rate of the fluid, which in turn improves the fluid delivering efficiency and the hydraulic performance of the heat collecting pump 10.

Figure 5:
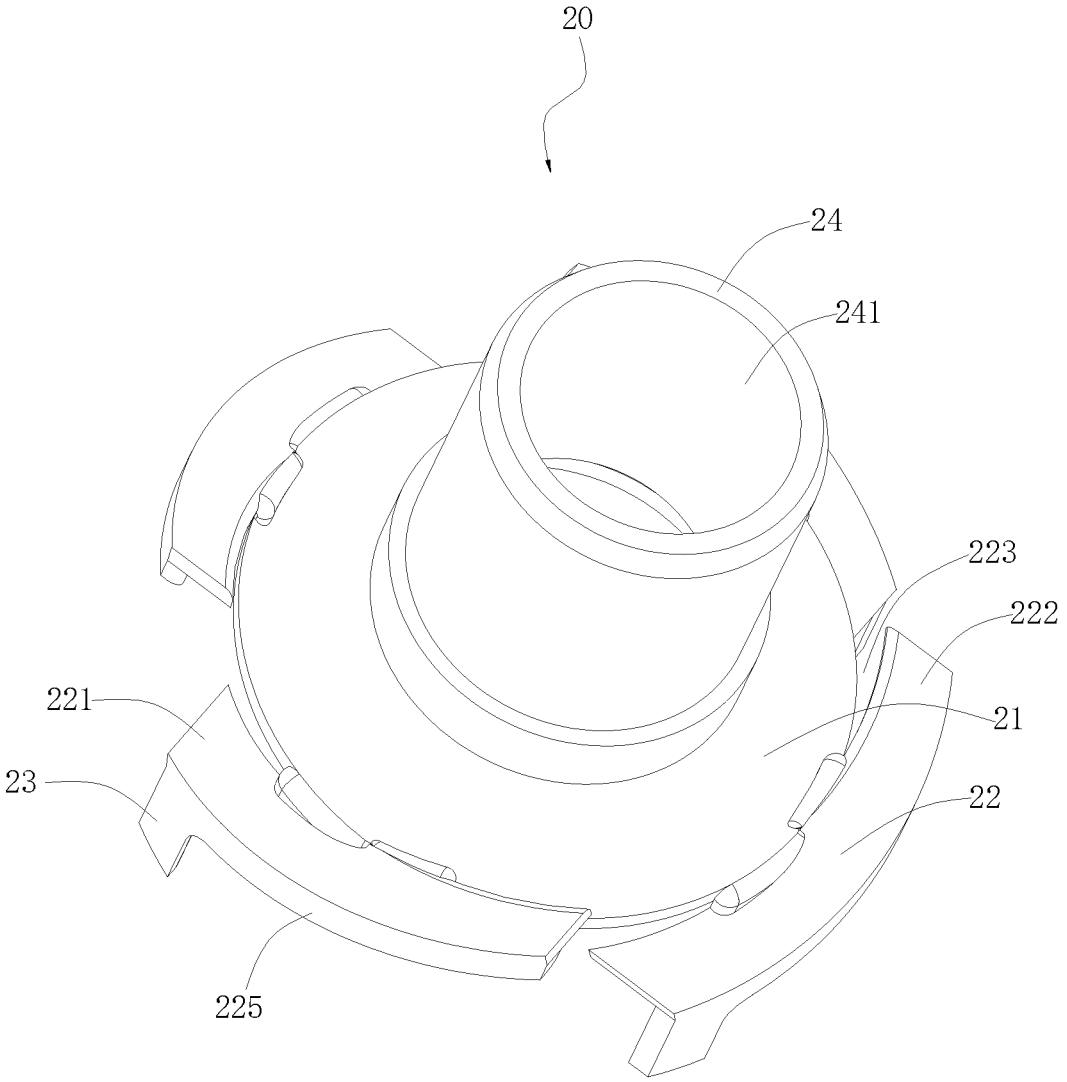
FIG. 5 is a schematic structural view of a flow guiding element according to an embodiment of the present disclosure.
Figure 6:
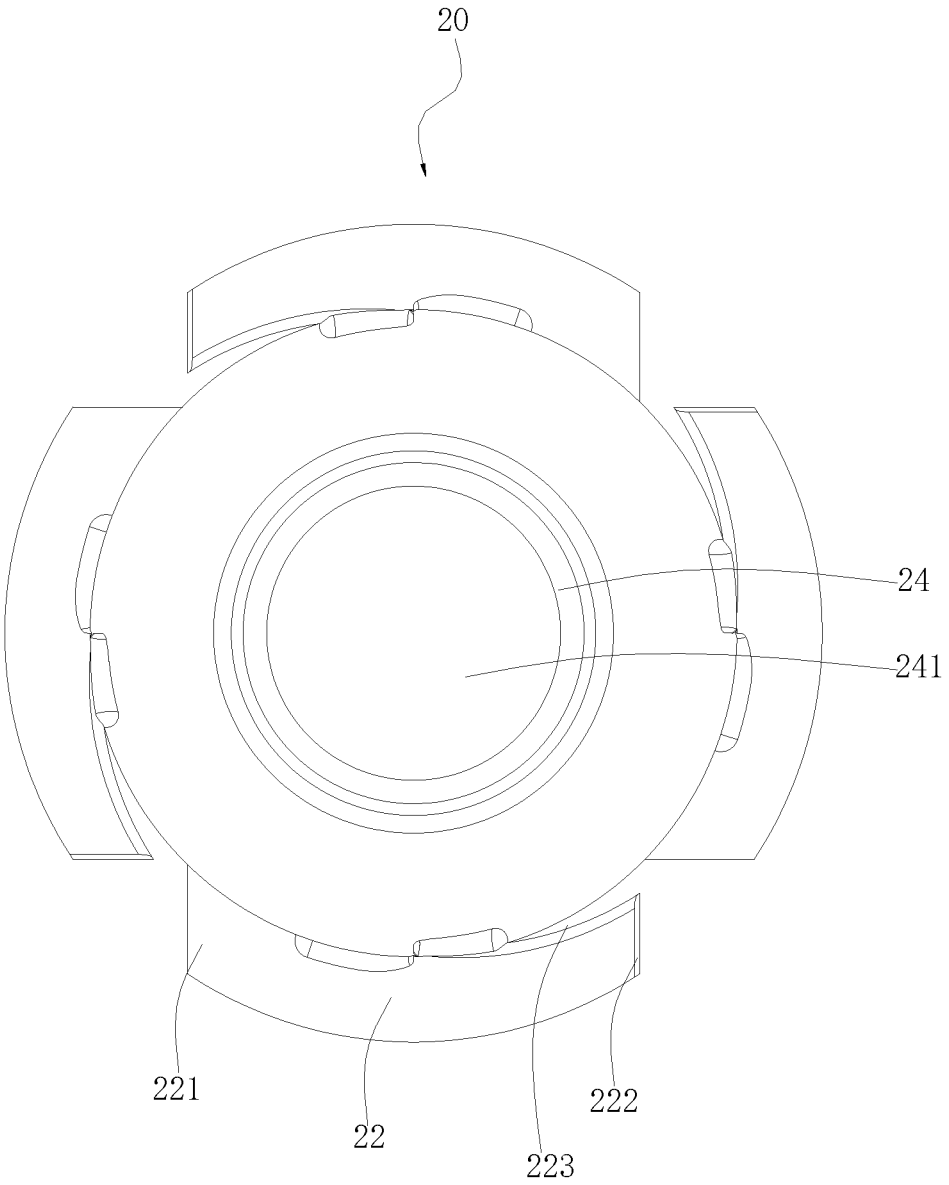
FIG. 6 is a schematic plan view of a flow guiding element according to an embodiment of the present disclosure.

Referring to FIG. 4 to FIG. 6, further, the flow guiding element 20 includes an annular portion 21, flow guiding pieces 22, a support post 23, and a fluid inlet portion 24. The flow guiding pieces 22 is connected to a periphery of the annular portion 21 and arranged in a circumferential direction of the annular portion 21. Each of the flow guiding pieces 22 spirals upwards in the circumferential direction of the annular portion 21. The support post 23 extends from the flow guiding piece 22 in an axial direction of the annular portion 21. The fluid inlet portion 24 extends from the annular portion 21 in the axial direction of the annular portion 21.

In the flow guiding element 20 according to the above embodiments, each of the flow guiding pieces 22 spirals in the circumferential direction of the annular portion 21, and the flow guiding pieces 22 can guide the fluid to flow spirally. Thus, it is possible to increase the flow rate of the fluid, which can in turn improve the fluid delivering efficiency of the heat collecting pump 10.

Referring to FIG. 4 and FIG. 5, in some embodiments, the support post 23 and the fluid inlet portions 24 are located on two sides of the annular portion 21, respectively. In the embodiment, one support post 23 is formed on each of the flow guiding pieces 22. It should be understood that, in other embodiments, supporting posts 23 may be formed on each of the flow guiding pieces 22, and the specific number of the supporting posts 23 may be set as desired, which is not limited herein.

With the arrangement of the support post 23, the installation and locating of the flow guiding element 20 can be facilitated, which in turn limits a relative position of the flow guiding element 20 to the casing 11. Thus, stability of the flow guiding element 20 and the casing 11 can be enhanced.

Here, the support post 23 and the flow guiding piece 22 may be integrally formed. In this way, components to be assembled can be reduced, and the flow guiding element 20 is thus simplified in structure. In other embodiments, the support post 23 and the flow guiding piece 22 may also be separately formed. For example, the support post 23 and the flow guiding piece 22 may be connected to each other through adhesive bonding, snapping, screwing, or the like, and the specific connection may be set as desired, which is not limited herein.

In the embodiment of the present disclosure, the support post 23 may have a rectangular block-like form. In other embodiments, the support post 23 may also have other forms, and the specific form of the support post 23 may be selected as desired, which is not limited herein.

Referring to FIG. 5 and FIG. 6, further, the fluid inlet portion 24 has a fluid inlet channel 241. The fluid may enter the flow guiding element 20 through the fluid inlet channel 241, and then is guided by the flow guiding pieces 22 to spirally flow. Thus, the flow rate of the fluid can be increased, which can in turn improve the fluid delivering efficiency of the heat collecting pump 10.

In the embodiments of the present disclosure, both the fluid inlet portion 24 and the fluid inlet channel 241 have a cylindrical shape. In other embodiments, the fluid inlet portion 24 and the fluid inlet channel 241 may also have other shapes such as a rectangular shape, a trapezoidal shape, or the like, and the specific shapes of the fluid inlet portion 24 and the fluid inlet channel 241 may be selected as desired, which is not limited herein.

In some embodiments, a cross-sectional area of at least a part of the annular portion 21 gradually increases in a direction away from the fluid inlet portion 24. The at least part of the annular portion 21 covers the impeller of the heat collecting pump 100. The annular portion 21 is spaced apart from and the impeller 12 in an axial direction of the impeller 12. In this way, it can be ensured that fluid flow entering the fluid inlet portion 24 can be pressurized and accelerated by the impeller 12.

Referring again to FIG. 3, in the embodiment, the fluid inlet 1112 of the upper casing 111 is sleeved over the fluid inlet portion 24. In this way, it is possible to prevent the fluid from flowing into the fluid channel 1114 from a gap between the upper casing 111 and the fluid inlet portion 24, which facilitates normal operation of the heat collecting pump 10.

Referring to FIG. 4 and FIG. 5, in some embodiments, each of the flow guiding pieces 22 includes a first end 221 and a second end 222 opposite to the first end 221. The first end 221 and the second end 222 are arranged in the circumferential direction of the annular portion 21. In a radial direction of the annular portion 21, a gap 223 is defined between the first end 221 and the annular portion 21 and/or the second end 222 and the annular portion 21.

A connection area between the flow guiding piece 22 and the annular portion 21 can be reduced to decrease resistance between the fluid and the flow guiding pieces 22. In this way, the flow of the fluid is smoother when the fluid is guided by the flow guiding piece 22. Thus, flow loss of the fluid can be reduced.

Further, the first end 221 is located at a lower level than the second end 222.

When the fluid passes through the second end 222 from the first end 221 and flows out of the flow guiding pieces 22, the fluid can be easily formed into the spiral form. In this case, this spiral fluid has a higher flow rate. Thus, it is possible for the fluid to flow into the fluid channel 1114 better and to be brought into contact with the heating element 1115. Therefore, the heating efficiency of the heat collecting pump 10 can be improved.

In the embodiments of the present disclosure, for two adjacent flow guiding pieces 22 of the flow guiding pieces 22 arranged in the circumferential direction of the annular portion 21, the second end 222 of one of the two adjacent flow guiding pieces 22 is located at a higher level than the first end 221 of the other one of the two adjacent flow guiding pieces 22.

When flowing along the flow guiding pieces 22, the fluid can be easily formed into the spiral shape. In this case, this spiral fluid has a higher flow rate. Thus, it is possible for the fluid to flow into the fluid channel 1114 better and to be brought into contact with the heating element 1115. Therefore, the heating efficiency of the heat collecting pump 10 can be improved.

In some embodiments, the flow guiding pieces 22 and the annular portion 21 may be integrally formed. Therefore, the components to be assembled can be reduced, and the flow guiding element 20 is simplified in structure. In other embodiments, the flow guiding piece 22 and the annular portion 21 may also be formed separately. For example, the flow guiding pieces 22 and the annular portion 21 may be connected to each other through adhesive bonding, snapping, screwing, or the like, and the specific connection may be selected as desired, which is not limited herein.

Referring to FIG. 4 and FIG. 5, further, each of the flow guiding pieces 22 has a flow guiding surface 224 facing upwards and a side surface 225 connected to the flow guiding surface 224. The flow guiding surface 224 has a width gradually decreasing in a spiral direction of the flow guiding piece 22.

In the embodiments of the present disclosure, the fluid flows along the flow guiding surface 224, and the width of the flow guiding surface 224 gradually decreases in the spiral direction of the flow guiding piece 22. In this way, a contact area between the fluid and the flow guiding surface 224 gradually decreases. Therefore, the resistance to the fluid due to the flow guiding surface 224 can be decreased to reduce flowing loss of the fluid and increase the flow rate of the fluid. Thus, the fluid flowing out of the flow guiding surface 224 can be formed into a spiral flow better, which can improve the fluid delivering efficiency of the heat collecting pump 10.

With the arrangement of the side surface 225, it is possible to prevent the fluid from flowing out of a periphery of the flow guiding surface 224 when the fluid flows along the flow guiding surface 224, which enables the fluid to fully pass through the flow guiding surface 224 and out of the flow guiding pieces 22. In this way, the fluid can be formed into the spiral flow better, which can improve the fluid delivering efficiency of the heat collecting pump 10.

In the embodiment, with the arrangement of the flow guiding pieces 22, it is possible for the fluid to be formed into the spiral form in the fluid channel 1114. Also, with the arrangement of the motor 13 and the impeller 12, the fluid can be formed into the vortex form in the fluid channel 1114. Thus, with the simultaneously operation of the flow guiding pieces 22 and the impeller 12, the fluid can flow in the fluid channel 1114 at a higher flow rate to form significant vortex, which can in turn improve the fluid delivering efficiency of the heat collecting pump 10.

Here, the impeller 12 has a same rotation direction as the flow guiding piece 22.

Further, in the embodiments of the present disclosure, the side surface 225 has a constant width in the spiral direction of the flow guiding piece 22.

In this way, the flow guiding pieces 22 are formed and manufactured simply, which can improve mass production of the flow guiding pieces 22 to further improve mass production of the flow guiding element 20 and the heat collecting pump 10.

It should be understood that, in other embodiments, the side surface 225 may have a variable width in the spiral direction of the flow guiding piece 2, and the width of the side surface 225 may be set as desired, which is not limited herein.

Referring to FIG. 3, in some embodiments, a distance h between an end, close to the impeller 12 of each of the flow guiding pieces 22 and a bottom of the impeller 12 is greater than or equal to half of a thickness g of the impeller 12.

When the impeller 12 is in operation, the impeller 12 would not be affected by the flow guiding pieces 22. Thus, operation stability of the impeller 12 can be improved.

There is a predetermined space between the impeller 12 and the flow guiding piece 22. The space may be configured to store a fluid that is not formed into the vortex form. When the impeller 12 is in operation, the fluid stored in the space can be formed into the vortex form. The fluid delivering efficiency of the heat collecting pump 10 can thus be improved.

The distance h between the end of the flow guiding piece 22 close to the impeller 12 and the bottom of the impeller 12 is not only greater than or equal to half of the thickness g of the impeller 12, and the specific value may be set as desired, which is not limited herein.

Referring to FIG. 4, in some embodiments, the flow guiding element 20 is provided with an inserting portion inserted into and fit with the fluid inlet 112. In some embodiments, the inserting portion 25 of the flow guiding element 20 is formed at an end of the fluid inlet portion 24 in an axial direction. The inserting portion 25 may have a smaller outer diameter than the fluid inlet portion 24. In this way, the inserting portion 25 can be easily inserted into the fluid inlet 1112, or an outer peripheral wall of the fluid inlet portion 24 can be in interference fit with an inner peripheral wall of the fluid inlet 1112, to connect the flow guiding element 20 and the upper casing 111. Further, an engagement groove may be formed on an inner peripheral wall of the fluid inlet 1112, and an engagement protrusion may be formed on an outer peripheral wall of the inserting portion 25. The engagement groove is engaged with the clamping protrusion to limit a circumferential rotation of the flow guiding element 20 due to the fluid flow. Thus, the fluid can be guided better.

Referring to FIG. 4, in some embodiments, a flow guiding cover 30 is provided between the flow guiding element 20 and the upper casing 111, and has a spiral surface 31 formed on a side of the flow guiding cover 30 close to the flow guiding element 20. When the fluid in the fluid channel 1114 passes through the spiral surface 31, spiral performance of the fluid can be further enhanced to improve the fluid delivering efficiency of the heat collecting pump 10.

Further, an operation of the heat collecting pump of the present disclosure will be explained below.

Referring to FIG. 2, a fluid A and a fluid B flow into the heat collecting pump 10 from the fluid inlet 1112, and then is form into a vortex in the fluid channel 1114 by the flow guiding element 20 and the impeller 12, and finally flow out of the fluid outlet 1113.

In some embodiments, the forming of the vortex in the fluid channel 1114 will be explained below.

Referring to FIG. 3, the fluid first flows into the fluid inlet channel 214 from the fluid inlet 1112, and then into the flow guiding piece 22 from the fluid channel 214. With the guiding of the flow guiding piece 22, the fluid flows out of the second end 222 of the flow guiding piece 22. Since the second end 222 is located at a predetermined level, in this case, the fluid flowing out of the second end 222 is easily formed into the vortex.

In addition, when in operation, the impeller 12 can further act on the fluid in the fluid channel 1114 to enable the fluid in the fluid channel 1114 to be fully formed into the vortex.

In summary, in the household appliance 100, the heat collecting pump 10, and the flow guiding element 20 according to the embodiments of the present disclosure, the flow guiding pieces 22 spirals in the circumferential direction of the annular portion 21, and the flow guiding pieces 22 can guide the fluid to flow in the spiral form. Thus, it is possible to increase the flow rate of the fluid, which can in turn improve the fluid delivering efficiency of the heat collecting pump 10. In one embodiment, when in operation, the impeller 12 can also enable the fluid in the fluid channel 1114 to be formed into the vortex. With the cooperation of the impeller 12 and the flow guiding pieces 22, it is possible for the fluid to be fully formed into the spiral form, which can increase the flow rate of the fluid and improve the fluid delivering efficiency of the heat collecting pump 10.

In the specification, descriptions with reference to the terms "an embodiment", "some embodiments", "illustrative embodiments", "an example", "a specific example", "some examples", etc., mean that specific features, structure, materials or characteristics described in conjunction with the embodiment or example are included in at least one embodiment or example of the present disclosure. In this specification, the schematic representations of the above terms do not necessarily refer to the same embodiment or example. The described specific features, structures, materials or characteristics may be combined in any one or more embodiments or examples in a suitable manner.

Although embodiments of the present disclosure have been illustrated and described above, various changes, modifications, replacements, and variations can be made to these embodiments. The scope of the present disclosure shall be defined by the claims as appended and their equivalents.

What is claimed is:

1. A flow guiding element for a heat collecting pump, the flow guiding element comprising: an annular portion; a plurality of flow guiding pieces connected to a periphery of the annular portion and arranged in a circumferential direction of the annular portion, each of the plurality of flow guiding pieces spiraling upwards in the circumferential direction of the annular portion; and a support post extending downwards from each of the plurality of flow guiding pieces in an axial direction of the annular portion.

2. The flow guiding element according to claim 1, wherein:

in the circumferential direction of the annular portion, each of the plurality of flow guiding pieces has a first end and a second end opposite to the first end; and in a radial direction of the annular portion, a gap is defined between the first end and the annular portion and/or between the second end and the annular portion.

3. The flow guiding element according to claim 1, wherein:

in the circumferential direction of the annular portion, each of the plurality of flow guiding pieces has a first end and a second end opposite to the first end, the first end being located at a lower level than the second end; and for two adjacent flow guiding pieces of the plurality of flow guiding pieces arranged in the circumferential direction of the annular portion, the second end of a first of the two adjacent flow guiding pieces is located at a higher level than the first end of a second of the two adjacent flow guiding pieces.

4. The flow guiding element according to claim 1, wherein:

each of the plurality of flow guiding pieces has a flow guiding surface facing upwards and a side surface connected to the flow guiding surface; and the flow guiding surface has a width gradually decreasing in a spiral direction of perspective flow guiding piece.

5. The flow guiding element according to claim 4, wherein the side surface has a constant width in the spiral direction of the flow guiding piece.

6. The flow guiding element according to claim 1, further comprising a fluid inlet portion extending from the annular portion in an axial direction of the annular portion, wherein the fluid inlet portion has a fluid inlet channel.

7. The flow guiding element according to claim 6, wherein:

a cross-sectional area of at least a part of the annular portion gradually increases in a direction away from the fluid inlet portion;

at least part of the annular portion covers an impeller of the heat collecting pump; and the annular portion is spaced apart from the impeller in an axial direction of the impeller.

8. A heat collecting pump, comprising:

a casing; and a flow guiding element for a heat collecting pump, the flow guiding element comprising:

an annular portion;

a plurality of flow guiding pieces connected to a periphery of the annular portion and arranged in a circumferential direction of the annular portion, each of the plurality of flow guiding pieces spiraling upwards in the circumferential direction of the annular portion, wherein the flow guiding element is disposed in the casing; and a support post extending downwards from each of the plurality of flow guiding pieces in an axial direction of the annular portion.

9. The heat collecting pump according to claim 8, further comprising an impeller disposed in the casing and located below the flow guiding element, wherein a distance between an end, close to the impeller, of each of the plurality of flow guiding pieces and a bottom of the impeller is greater than or equal to half of a thickness of the impeller.

10. The heat collecting pump according to claim 9, further comprising:

a motor disposed in the heat collecting pump;

the casing includes an upper casing, and a lower casing, wherein:

the impeller is located in the lower casing, and the motor is connected to the impeller and configured to drive the impeller to rotate.

11. The heat collecting pump according to claim 8, further comprising:

an upper casing having a fluid inlet, a fluid outlet, and a fluid channel in communication with the fluid outlet; and a lower casing, wherein:

a heating element is disposed in the fluid channel, and the flow guiding element is disposed in the fluid channel.

12. The heat collecting pump according to claim 11, wherein the flow guiding element has an inserting portion inserted into and engaged with the fluid inlet.

13. The heat collecting pump according to claim 11, wherein a flow guiding cover is disposed between the flow guiding element and the upper casing, and has a spiral surface on a side of the flow guiding cover close to the flow guiding element.

14. A dishwasher, comprising:

a heat collecting pump, comprising:

a casing; and a flow guiding element for a heat collecting pump, the flow guiding element comprising:

an annular portion;

a plurality of flow guiding pieces connected to a periphery of the annular portion and arranged in a circumferential direction of the annular portion, each of the plurality of flow guiding pieces spiraling upwards in the circumferential direction of the annular portion, wherein the flow guiding element is disposed in the casing; and a support post extending downwards from each of the plurality of flow guiding pieces in an axial direction of the annular portion.

* * * * *